US005682427A

United States Patent [19]

Seestrom

[11] Patent Number: 5,682,427

[45] Date of Patent: Oct. 28, 1997

[54] POSTAGE METERING SYSTEM WITH DEDICATED AND NON-DEDICATED POSTAGE PRINTING MEANS

[75] Inventor: Frank E. Seestrom, Weston, Conn.

[73] Assignee: Pitney Bowes Inc., Stamford, Conn.

[21] Appl. No.: 356,748

[22] Filed: Dec. 15, 1994

[51] Int. Cl.[6] ..... G07B 17/00

[52] U.S. Cl. ..... 380/51; 380/55; 364/464.18

[58] Field of Search ..... 380/51, 54, 55; 364/464.02

[56] References Cited

U.S. PATENT DOCUMENTS

| | | | |
|---|---|---|---|
| 4,743,747 | 5/1988 | Fougere et al. | 380/51 X |
| 4,864,618 | 9/1989 | Wright et al. | 380/51 |
| 4,949,381 | 8/1990 | Pastor | 380/51 |

*Primary Examiner*—Gilberto Barron, Jr.

*Attorney, Agent, or Firm*—Charles R. Malandra, Jr.; David E. Pitchenik; Melvin J. Scolnick

[57] ABSTRACT

A postage metering system comprising: a postage meter including a first computer for controlling the postage meter, the postage meter including a first printer for printing first postage information; a non-secure second printer external to the postage meter for printing second postage information, a second computer external to the postage meter and connected for controlling the second printer, the second computer including first structure for transmitting to the first computer variable information including at least a portion of a mailing address associated with an item to be imprinted with the second postage information; the first computer including structure for encrypting at least a portion of the transmitted variable information, the first computer including second structure for transmitting to the second computer the encrypted information for printing by the second printer on said item.

20 Claims, 3 Drawing Sheets

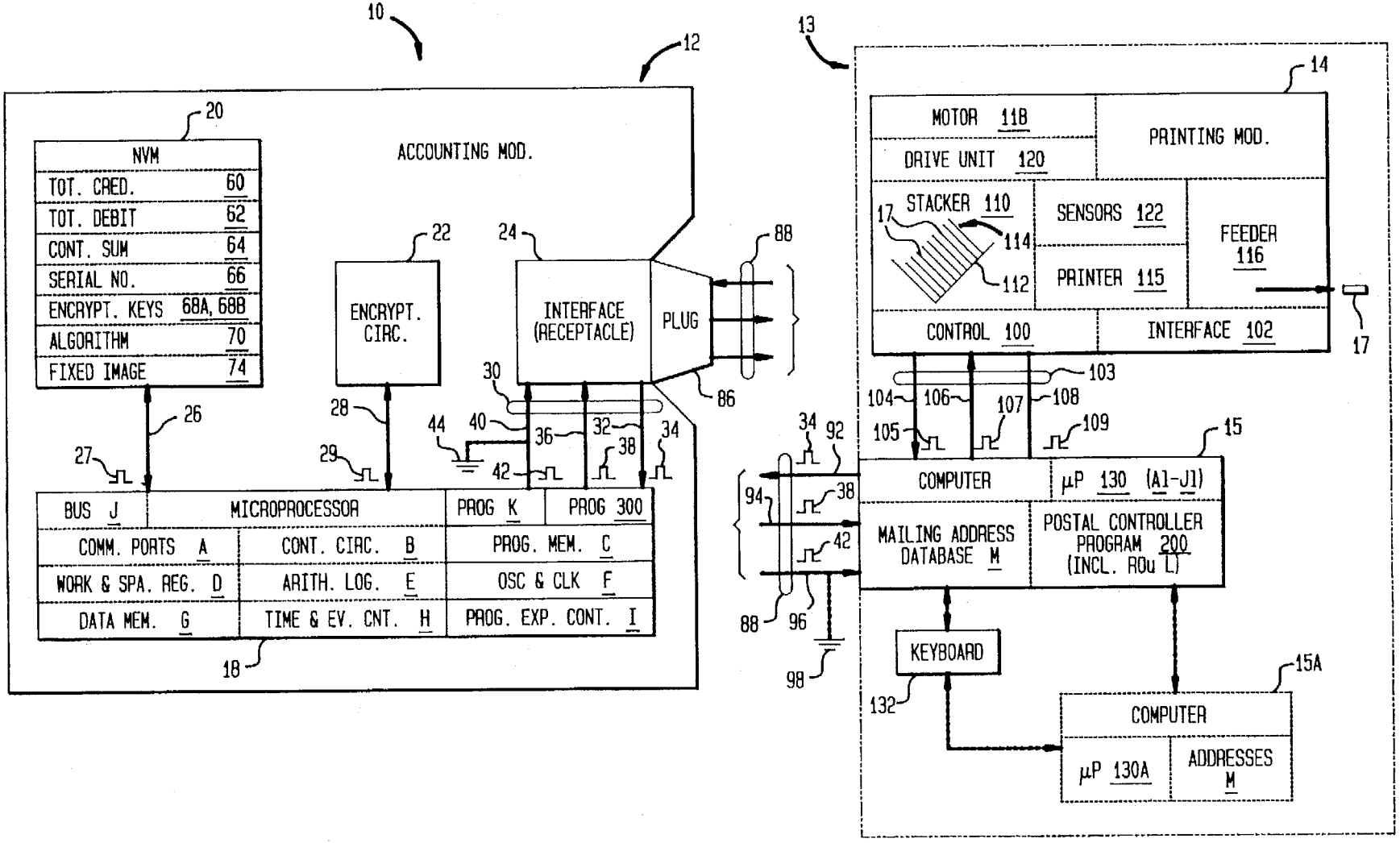
FIG. 1
PRINTING MOD.
FEEDER 116
INTERFACE 102
MOTOR 118
DRIVE UNIT 120
SENSORS 122
PRINTER 115
STACKER 110
CONTROL 100
μP 130 (A1-J1)
POSTAL CONTROLLER PROGRAM 200 (INCL. ROM L)
COMPUTER
MAILING ADDRESS DATABASE M
KEYBOARD
COMPUTER
ADDRESSES M
μP 130A
PLUG
INTERFACE (RECEPTACLE)
ACCOUNTING MOD.
ENCRYPT. CIRC.
NVM
TOT. CRED. 60
TOT. DEBIT 62
CONT. SUM 64
SERIAL NO. 66
ENCRYPT. KEYS 68A, 68B
ALGORITHM 70
FIXED IMAGE 74
MICROPROCESSOR
BUS J
COMM. PORTS A
WORK & SPA. REG. D
DATA MEM. G
CONT. CIRC. B
ARITH. LOG. E
TIME & EV. CNT. H
PROG K
PROG. MEM. C
OSC & CLK F
PROG. EXP. CONT. I
PROG 300

POSTAGE METERING SYSTEM WITH DEDICATED AND NON-DEDICATED POSTAGE PRINTING MEANS

BACKGROUND OF THE INVENTION

This invention is generally concerned with a postage metering system including dedicated and non-dedicated postage printing means, and more particularly with a postage metering system including a postage meter having printing means dedicated to printing postage and, optionally, addresses, on items, including labels and letters, and having computer means adapted to be connected to external apparatus including printing means which is not dedicated to printing postage or addresses.

This Patent Application is one of the following three, concurrently filed, related, patent applications assigned to the same assignee: U.S. patent application Ser. No. 08/356,747 for a Postage Accounting System Including Means For Transmitting A Bit-Mapped Image Of Variable Information For Driving An External Printer, filed by Seestrom (Attorney Docket No. E-306), which has issued as U.S. Pat. No. 5,539,279; U.S. patent application Ser. No. 08/356,749 for a Postage Accounting System Including Means For Transmitting ASCII Encoded Variable Information For Driving An External Printer, filed by Ramadei (Attorney Docket No. E-307); and U.S. patent application Ser. No. 08/356,748 for a Postage Metering System With Dedicated and Non-Dedicated Postage Printing Means, filed by Seestrom (Attorney Docket No. E-308).

Various postage metering systems have been developed. Examples of such systems are disclosed in: U.S. Pat. No. 4,641,346 for a System For The Printing And Reading Of Encrypted Messages filed by Clark et. al., issued Feb. 3, 1987 and assigned to the assignee of the present invention; U.S. Pat. No. 4,641,347 for a System For Printing Encrypted Messages With A Character Generator And Bar-Code Representation filed by Clark et. al., issued Feb. 3, 1987 and assigned to the assignee of the present invention; U.S. Pat. No. 5,121,432 for a Franking Machine, With Printing Device External To Secure Housing filed by Gilham et. al. and issued Jun. 9, 1992; U.S. Pat. No. 5,140,675 for Printer Controller Apparatus Interfacing With External Data Sources filed by Okada and issued Aug. 18, 1992; U.S. Pat. No. 5,200,903 for a Franking Machine filed by Gilham and issued Apr. 6, 1993; and, U.S. Pat. No. 5,278,947 for a System For Automatic Printing of Mail Pieces filed by Balga, Jr. et. al., issued Jan. 11, 1994 and assigned to the assignee of the present invention.

The most pertinent of the aforesaid references are: U.S. Pat. No. 5,121,432, which discloses a postage metering means located in a separate housing from that of the printing structure; U.S. Pat. No. 5,140,675 which discloses a printer unit having a data processor connected thereto for processing internal data and data received from multiple sources for driving the printing unit; and, U.S. Pat. No. 5,200,903 which discloses a franking machine including an input/output connection for receiving franking and addressing data from a computer for controlling the franking machine to print a franking impression and destination address on a mail item.

However, the references are silent concerning the provision of a postage meter which includes both the accounting and printing structures of a self-contained postage meter and additionally includes an encryption circuit and a communications interface, for receiving plain text versions of a mailing addresses from an external source and providing encrypted versions thereof for printing by external printing structure along with the respective plain text versions of the postage indicias. Moreover, the references are silent concerning the provision of the aforesaid postage meter which utilizes the interface structure for transmitting both plain text and encrypted versions of respective portions of postage indicias for printing by an external printer on respective labels and letters.

Accordingly:

an object of the invention is to provide a postage metering system including means for printing a postage indicia, including both plain text and encrypted versions of at least a portion of a mailing address, on labels and letters;

another object is to provide a postage meter including an interface for communicating with an external source of plain text versions of portions of respective mailing addresses and sequentially encrypting respective portions of mailing addresses for printing by an external printer on respective items including labels and letters along with the respective plain text versions thereof; and yet another object is to provide a postage meter including means for communicating with an external printing system having a printing module and a source of plain text versions of mailing addresses, means for encrypting respective portions of the mailing addresses which are to be printed on respective items by the printing module, and means for providing the printing module with the encrypted portion of each mailing address for printing with the plain text version thereof, whereby the plain text portion of the mailing address printed on each item may be encrypted for comparison with the encrypted portion printed on the item for verification thereof and thus of the authenticity of the plain text version thereof.

SUMMARY OF THE INVENTION

A postage metering system comprising: a postage meter including first computer means for controlling the postage meter, the postage meter including first printing means for printing first postage information; non-secure second printing means external to the postage meter for printing second postage information, second computer means external to the postage meter and connected for controlling the second printing means, the second computer means including first means for transmitting to the first computer means variable information including at least a portion of a mailing address associated with an item to be imprinted with the second postage information; the first computer means including means for encrypting at least a portion of the transmitted variable information, the first computer means including second means for transmitting to the second computer means the encrypted information for printing by the second printing means on said item.

BRIEF DESCRIPTION OF THE DRAWINGS

As shown in the drawings, wherein like reference characters designate like or corresponding parts throughout the several views:

FIG. 1 is a schematic view of a postage metering system according to the invention, including a secure postage meter having a postage accounting computer module adapted to be connected to a non-secure printing system physically separated from the postage meter;

DESCRIPTION OF THE PREFERRED EMBODIMENTS

Figure 2:
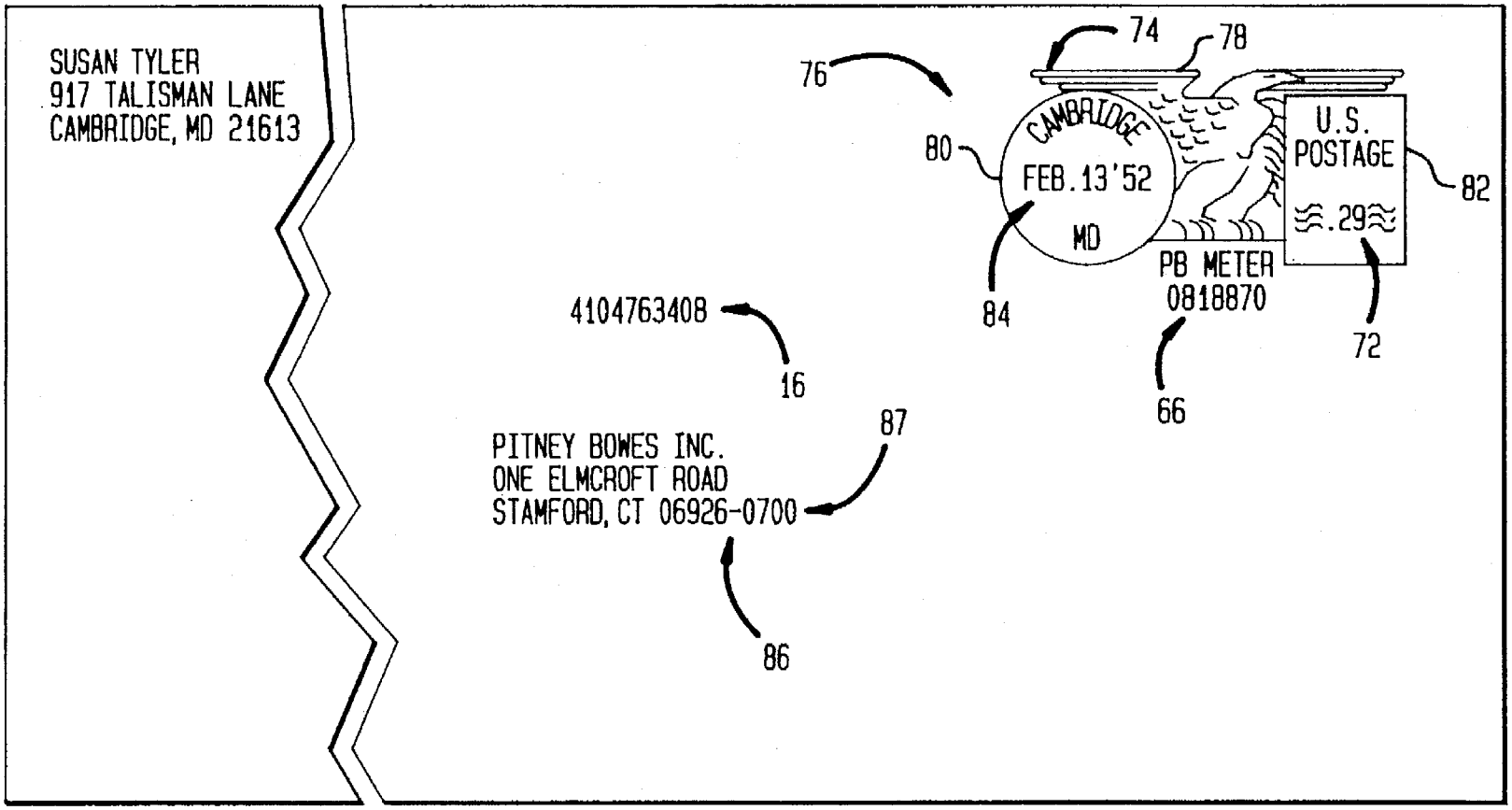
FIG. 2 is an elevation of an envelope having printed thereon a verifiable postage indicia printed by the non-secure printing system in accordance with encrypted information received from the secure accounting computer module.

As shown in FIG. 1, a postage metering system 10 according to the invention preferably comprises a conventional secure postage meter 11, including a postage printing module 11A, keyboard 11B and postage accounting computer module 12, wherein the accounting module 12 is modified to be connected in communication with an external, non-secure printing system 13, including a printing module 14 and local computer 15 therefor, for providing verifiable encrypted information 16 (FIG. 2) for printing on items, including labels, and letters such as a card, envelope or other letter, represented by the envelope 17.

The postage accounting computer module 12 (FIG. 1) generally includes a conventional microprocessor 18, and suitable non-volatile memory (NVM), encryption and interface structures, respectively designated 20, 22 and 24. And the printing module 11A and keyboard 11B, and non-volatile memory (NVM), encryption and interface structures, 20, 22, and 24, are conventionally connected to the microprocessor 18 and operable under the control thereof.

The microprocessor 18 (FIG. 1) may be any commercially available microprocessor having a sufficient number of communications ports "A" which are either already available or are programmable for serial, parallel or asynchronous communications, as the case may be, to provide separate communications links for the printing module 11A the external printing system 13 for communication therewith. Of course, without departing from the spirit and scope of the invention, the microprocessor 18 may include a plurality of microprocessors 18 to provide for additional communication ports "A" and other added capacities which may be called for in the course of implementation of the invention. Moreover, the microprocessor 18 generally includes a plurality of control circuits "B", a program memory "C", a plurality of working and spare registers "D", an arithmetic logic unit "E", circuits for one or more oscillators and clocks "F", data memory "G", timers and event counters "H" and program expansion control "I", and an internal communications bus "J". Further, the microprocessor 18 includes an application program 300 for controlling the various operations of the accounting module 12 discussed herein.

The printing module 11A (FIG. 1) is suitably electrically connected to the microprocessor 18 by means of a conventional communications link 25, extending from the microprocessor bus "J", for transmitting and receiving data signals, such as the signal 25A, and synchronizing communications between the microprocessor 18 and printing module 11A. Further, the non-volatile memory structure (NVM) 20 is suitably electrically connected to the microprocessor 18 by means of a conventional communications link 26, extending from the microprocessor bus "J", for transmitting and receiving data signals, such as the signal 27, and synchronizing communications between the microprocessor 18 and NVM 20. In addition, the encryption structure 22 is suitably electrically connected to the microprocessor 18 by means of a conventional communications link 28, extending from the microprocessor bus "J", for transmitting and receiving data signals, such as the signal 29, and synchronizing communications between the microprocessor 18 and encryption structure 22. Moreover, the interface structure 24 is suitably electrically connected to the microprocessor 18 by means of a serial, parallel or asynchronous communications link, represented by the serial communications link 30, which includes a data input lead 32, for receiving data signals, such the signal 34, from the printing system 13 for the microprocessor 18, a data output lead 36, for providing data signals, such as the signal 38, from the microprocessor 18 to the printing system 13, and a clock lead 40, for providing clock signals, such as the signal 42, from the microprocessor 18 to the printing system 13 for synchronizing communications therebetween. 0f course, assuming the provision of an asynchronous communications link 30, the lead 40 would be connected to the sink 44 of the accounting module 12. Further, the keyboard 11B, is suitably electrically connected to the microprocessor 18 by means of a serial or parallel communications link, represented by the serial communications link 45, which includes a data input lead 46, for receiving data signals, such the signal 47, from the keyboard 11B for the microprocessor 18, a data output lead 48, for providing data signals, such as the signal 49, from the microprocessor 18 to the keyboard 11B, and a clock lead 50, for providing clock signals, such as the signal 42, from the microprocessor 18 to the keyboard 11B for synchronizing communications therebetween.

The printing module 11A (FIG. 1) additionally includes conventional sheet stacking structure 52, such as a suitable hopper 53 into which a stack 54 of letters 17 may be loaded. The printing module 11A also includes conventional printing apparatus 55, such as any conventional impact, rotary, thermal, ink jet, laser or like commercially available printing apparatus to which letters 17 are fed from the hopper 53 for printing thereon both alphanumeric and graphic information. In addition, the printing module 11A includes conventional sheet feeding structure 56 operable under the control of the microprocessor 18. The feeding structure 56 may be any conventional vacuum or roller type structure for engaging the top or bottom letters 17 in the stack 54 and sequentially feeding respective letters 17 from the hopper 53 to the printing apparatus 55 and, after printing, sequentially feeding the letters 17 from the postage meter 11. Further, the printing module 11A includes a suitable motor 57, which is operable under the control of the microprocessor 18, and includes one or more drive units 58, which are respectively connected between the motor 57 and feeding structure 56. Moreover, the printing module 11A may include a plurality of conventional sensors 59 for sensing various positions of respective letters 17 and of selected elements of the feeding structure 56, motor 57 and drive units 58, including their respective home positions, at selected time intervals. The sensors 59 are conventionally electrically connected to the microprocessor 18 via the communication link 25 for providing analog signals 25A thereto, and the microprocessor 18 is conventionally constructed and arranged, for example as by programming, for providing digital signals 25A to printing module 11A for controlling the feeding structure 56, motor 57 and drive units 58, at selected time intervals.

The NVM 20 (FIG. 1) may be any commercially available non-volatile memory of the type which is suitable for use in a conventional postage meter for storing data which is critical to the operation of the meter and to guard against data access by the User and data losses due to power failures. Accordingly, the non-volatile memory (NVM) 20 preferably has sufficient capacity for storing data corresponding to a current total credit value 60, which is a total value postage currently available for printing, a current total debit value 62, which is the total of all increments of postage 72 which have been decremented from total credit values 60, a control sum 64, which is the sum of the aforesaid values 60 and 62, and a serial number 66 of the accounting module 12. Moreover, the NVM 20 preferably includes sufficient capacity for storing one or more first encryption keys 68A, which may be utilized in an algorithm 70 for changing the total credit and debit values, 60 and 62, under the control of the microprocessor 18. Preferably, the algorithm 70 is also stored in the NVM 20 and is normally implemented under the control of the microprocessor 18 for changing the total credit and debit values, 60 and 62, by decrementing the credit value 60 and incrementing the debit value 62 by an amount which is equal to a current increment of postage 72 (FIG. 2) which is to be printed by the printing module 14 (FIG. 1). Still further, the NVM 20 preferably has sufficient capacity for storing data corresponding to the fixed image portion 74 of a postage indicia 76 (FIG. 2), including, for example, a graphic image 74 of an eagle 78, town circle 80, value box 82 and the current date 84.

The encryption structure 22 (FIG. 1) is preferably conventionally operable under the control of the microprocessor 18 for encrypting at least alphanumeric data, and, optionally, both alphanumeric and graphic data, to provide verifiable encrypted information 16 (FIG. 2) for printing by either the postage meter 11 or printing module 14. Thus the encryption structure 22 is operable under the control of the microprocessor 18 for encrypting data corresponding to, for example, at least one or more of the numerical values stored in the NVM 20, including the current date, successive current increments of postage values 72 (FIG. 2) and at least a portion of the data corresponding to respective mailing addresses 86, such as the zip code of the respective addressees, and, optionally, in addition thereto, data corresponding to the graphic image 74, aside from the current date, stored in the NVM 20 (FIG. 1). To that end, the NVM 20 additionally has stored therein one or more second encryption keys 68B for use by the encryption structure 22. Without departing from the spirit and scope of the invention, the encryption structure 22 may be a suitable electrical circuit which is located externally of the microprocessor 18, or a conventional program "K" which is stored in the microprocessor 18, and operable under the control thereof. As noted above the encrypted information 16 printed on the envelope 17 is characterized as being "verifiable". In this connection it is noted that assuming the Postal Service has a computer having stored therein the program "K" and encryption keys 68, then, the plain text alphanumeric and graphic information on the face of the envelope 17 which is encrypted by the microprocessor 18 may be read from the envelope 17 and encrypted by the Postal Service computer to produce encrypted information which may be compared to the encrypted information 16 printed on the envelope 17, in order to verify that they are the same, whereby the relationship between the selected plain text and encrypted versions thereof which are printed on the envelope 17 may be authenticated.

The interface structure 24 (FIG. 1) is preferably a conventional electrical receptacle, which is constructed and arranged for receiving an electrical plug 86 of a communications link 88 from the control structure 15 of the printing system 13. The communications link 88 includes a data output lead 92, for providing data signals, such the signal 34, to the microprocessor 18, a data input lead 94, for receiving data signals, such as the signal 36, from the microprocessor 18 and a clock lead 96, for receiving clock signals, such as the signal 42, from the microprocessor 18 for synchronizing communications between the microprocessor 18 and printing system 13. Of course, assuming the provision of an asynchronous communications link 30 at the accounting module 12, the lead 96 would be connected to the sink 98 of the printing system 13.

The printing module 14 (FIG. 1) is preferably a conventional, standalone, device, which includes suitable structure 100, such as a microprocessor, for controlling the various structures and functions of the printing module 14. The printing module 14 may include a conventional operator interface 102, such as a suitable keyboard, which is conventionally coupled to the control structure 100 for operation thereof in response to input signals from the keyboard. Whether or not the printing module 14 includes an operator interface 102, the control structure 100 is preferably conventionally adapted to include a two-way serial or parallel communications link, represented by the serial communications link 103, for conventionally coupling the control structure 100 to an external source, such as the local computer 15. The communications link 103 includes a data output lead 104, for providing data signals, such the signal 105, to the local computer 15, a data input lead 106, for receiving data signals, such as the signal 107, from the local computer 15 and a clock lead 108, for receiving clock signals, such as the signal 109, from the local computer 15 for synchronizing communications between the local computer 15 and printing module 14. Thus the printing module 14 is preferably adapted to permit control of the structures and functions thereof from the local computer 15 rather than from the operator interface 102.

The printing module 14 (FIG. 1) additionally includes conventional sheet stacking structure 110, such as a suitable hopper 112 into which a stack 114 of items, including labels and letters, 17 may be loaded. The printing module 14 also includes conventional printing apparatus 115, such as any conventional thermal, ink jet, laser or like commercially available printing apparatus to which letters 17 are fed from the hopper 112 for printing at least alphanumeric information, and, preferably, both alphanumeric and graphic information. In addition, the printing module 14 includes conventional sheet feeding structure 116 which is suitably electrically connected to and operable under the control of the control structure 100 for sequentially feeding items, including labels and letters, 17 from the stack 114. The feeding structure 116 may be any conventional vacuum or roller type structure for engaging the top or bottom item 17 in the stack 114 and sequentially feeding respective items 17 from the hopper 112 to the printing apparatus 115 and, after printing, sequentially feeding the items 17 from the printing module 14. Further, the printing module 14 includes a suitable motor 118, which is connected to and operable under the control of the control structure 100, and includes one or more drive units 120, which are respectively connected between the motor 118 and feeding structure 116. Moreover, the printing module 14 may include a plurality of conventional sensors 122 for sensing various positions of respective items 17 and of selected elements of the feeding structure 116, motor 118 and drive units 120, including their respective home positions, at selected time intervals. The sensors 122 are conventionally electrically connected to the control structure 100 for providing analog signals thereto. And the control structure 100 is conventionally constructed arranged, for example as by programming in the case of the control structure 100 being a microprocessor, for providing digital signals, such as the signal 105, to the local computer 15 which correspond to the various positions of respective items 17, and to the respective positions of the selected elements of the feeding structure 116, motor 118 and drive units 120, at selected time intervals.

The local computer 15 (FIG. 1) is preferably any conventional, commercially available, computer, such as a conventional controller or personal computer. The local computer 15 preferably comprises a microprocessor 130, which includes a plurality of circuits, stored data and programs, A1–J1 inclusive, which respectively correspond in all respects to the circuits, stored data and programs, A–J inclusive, of the microprocessor 18. In addition, the local computer 15 preferably has stored therein a mailing address database "M" and a postal controller program 200 including a conventional routine "L" for calling up and accessing respective mailing addresses 86 (FIG. 2). Further, without departing from the spirit and scope of the invention, rather than, or in addition to, the printing module 14 including control structure 100, the local computer 15 may include a keyboard 132 for manually entering information concerning respective mailruns into the printing system 13 under the control of the microprocessor 130. Moreover, without departing from the spirit and scope of the invention, the local computer 15 may be a first computer 15, and the printing system 13 may include a second computer 15A which is conventionally connected in communication with the first computer 15, but wherein the second computer 15A, rather than the first computer 15, includes the mailing address database "M" and keyboard 132 and does not include the postal controller program 200, whereby the first computer 15 is a module including the microprocessor 130 having stored therein the postal controller program 200.

Assuming energization of the postage meter 11 (FIG. 1) and printing system 13, and initialization of the microprocessor 18 and various components of the printing module 11A, and of the computer 15 and various components of the printing module 14, the printing system program 200 (FIG. 3) initially implements the step 202 of inquiring whether a manually input request, 204, has been received, step 202, to establish a semi-permanent, i.e., "on-line", communication connection with the postage meter 11. And, assuming an on-line request has not been received, step 202, then, the program 200 continuously loops through step 202 until the on-line request 204 is received, step 202. Whereupon, the program 200 implements the step 206 of requesting that the postage meter 11 establish an on line communication connection with the printing system 13, followed by the step 208 of inquiring whether an acknowledgment of establishment of the on-line connection has been received from the postage meter 11, failing which, the program 200 continuously loops through step 208 until the acknowledgment is received. On the other hand, the postage meter program 300 initially implements the step 302 of inquiring whether an on-line request, 206, has been received, step 302, from the printing system 13, and, assuming that it has not, step 302, then, the program 300 continuously loops through step 302, until the request 206 is received, step 302. Whereupon, the program 300 causes the computer 15 to implement the step 304 of establishing the on-line connection and transmitting the acknowledgment thereof to the postage meter 11.

Thereafter, the printing system program 200 (FIG. 3) implements the step 210 of inquiring whether information pertaining to a mailrun, including the total number of items, including labels or letters, 17 which are to be processed, together with a request for the fixed image portion of the postage indicia, has been manually entered into the printing system computer 15 or 15A, as the case may be. And, assuming such mailrun information and the fixed image request, 212, has not been received, step 210, then, the program 200 continuously loops through step 210 until the mailrun information and fixed image request 212 is received, step 210. Whereupon, the program 200 implements the step 214 of transmitting the mailrun information and request for the fixed image portion of the indicia to the postage meter 11, followed by the step 216 of inquiring whether the fixed image portion has been received from the postage meter 11, failing which, the program 200 continuously loops through step 216 until the fixed image portion is received. On the other hand, following step 304, the postage meter program 300 implements the step 306 of inquiring whether the mailrun information and request for the fixed image portion of the indicia 214 has been received from the printing system 13, and, assuming that it has not, step 306, then, the program 300 continuously loops through step 306, until the mailrun information and fixed indicia request 214 is received, step 306. Whereupon, the program 300 causes the microprocessor 18 to implement the step 308 of transmitting a bit-mapped image of the fixed portion of the indicia to the printing system 13, for sequential use thereby in the course of sequentially processing each of the items 17 of the mailrun.

Following implementation of step 216, the printing system program 200 (FIG. 3) implements the step 218 of transmitting to the postage meter 11 a request for the variable portion the postage indicia, including the postage value 72 which is to be printed together with at least a selected portion of the mailing address, such as, and preferably, the nine digit zip code 87 of the mailing address 86 which is to be printed, on the first item 17 of the mailrun, followed by the step 220 of inquiring whether the requested postage indicia for the particular mailing address has been received. And, assuming the postage indicia as requested in step 218 is not received, step 220, then, the program 200 continuously loops through step 220 until it is received for the particular item 17. On the other hand, following step 308, the postage meter program 300 causes the microprocessor 18 to implement the step 310 of inquiring whether the printing system 13 has transmitted the request, step 218, for the postage indicia accompanied by the selected portion or all of the mailing address, for the first item 17 of the mailrun, and, assuming that it has not, then, the program 300 continuously loops through step 310 until the request for the particular addressee has been received. However, upon receiving the request for postage indicia accompanied by the selected portion or all of the mailing address, step 310, then, the postage meter program 300 causes the microprocessor 18 to implement the step 312 of generating the encrypted information 16 (FIG. 2) for printing on the first item of the mailrun, by encrypting the plain text version of the variable portion of the postage indicia which is to be printed, including at least the postage value 72, and encrypting information included in the mailing address 86, and merging such encrypted indicia and address information to form the encrypted information 16. Thereafter, the postage meter program 300 causes the microprocessor 18 to implement the step 313 of accounting for the current increment of postage value 72 which is to be printed, followed by the step 314 of transmitting a bit-mapped image of the encrypted information 16 and plain text postage value 72 to the printing module 13 for printing thereby. Accordingly, the printing system 13 does not receive, and thus cannot print, respective increments of postage values 72 without the postage accounting computer module 12 not having previously decremented the total credit value 60 and incremented the total debit value 62, stored in the NVM 20, by respective amounts corresponding to the respective increments of postage values 72 which are to be printed. Moreover, the item 17 will have printed thereon encrypted information 16 in which there is embedded an encrypted version of the variable postage value 72 and an encrypted version of information included in the mailing address of the item 17 on which the plain text versions of the postage indicia 74 and mailing address 86 are also printed.

When the requested variable portion of the postage indicia is received, step 220 (FIG. 3), the printing system program 200 causes the computer 15 to implement the step 222 of transmitting a request to the postage meter 11 to print the postage indicia, followed by implementing the step 224 of inquiring whether permission to print has been received from the postage meter 11. And, until permission to print is received from the postage meter 11, the program 200 causes the computer 15 to continuously loop through step 224. 0n the other hand, following step 314, the accounting module program 300 causes the microprocessor 18 to implement the step 316 of inquiring whether a request to print, step 222, has been received from the postage meter 11, failing which, the program 300 causes the microprocessor 18 to continuously loop through step 316 until the request to print is received, step 316. And, when the request to print is received, step 316, the program 300 causes the microprocessor 18 to implement the step 320 of transmitting a permission-to-print message to the printing module 13.

Upon receiving the permission-to-print message, step 224 (FIG. 3), the printing system program 200 implements the step 226 of causing the computer 15 to conventionally operate the printing module 14 for causing the sheet feeding structure 116 to feed the first item 17 from the stack 114 to the printing structure 115, causing the printing structure 115 to print the fixed and variable portions of the postage indicia 76 and the encrypted information 16 on the first item 17, and then causing the feeding structure 116 to feed the first item 17 from the printing module 14. Thereafter, the printing system program 200, implements the step 228 of inquiring whether the prior item, for example, the first label or letter, 17 was the last item 17 of the mailrun. Assuming the answer to the inquiry of step 228 is negative, then, the program 200 returns processing to step 218. Thereafter, the printing module program 200 causes the computer 15 to continuously sequentially implement steps 218 through 228, inclusive, for causing the printing module 13 to sequentially process each of the items 17, until the inquiry of step 228 is answered affirmatively. Whereupon the printing system program 200 implements the step 230 of causing the computer 15 transmit a request to the postage meter 11 to disconnect the on-line communication connection with the printing system 13, followed by the step 232 of inquiring whether an acknowledgment of the request has been received. On the other hand, following implementation of step 320, the postage meter program 300 implements step 322, of delaying processing by the program 300 for a time interval which is sufficient to allow for the printing system program 200 reasonably to complete implementation of steps 226 and 228, thereby allowing for the printing system 13 to print the postage indicia and encrypted information on the item 17 and allow for the of inquiry of step 228 to be either negatively of affirmatively answered. And, at the end of the time delay, step 322, the postage meter program 300 implements the step 324 of inquiring whether a request for disconnecting the on-line connection has been received by the postage meter 11. Assuming the inquiry of step 324 is negatively answered, then the postage meter program 300 returns processing to step 310. Thereafter, the program 300 causes the microprocessor 18 to continuously sequentially implement steps 310 through 324, inclusive, for causing the postage meter 11 to sequentially transmit respective plain text versions of postage values together with associated encrypted information including the respective postage values, to the printing system 13, and to account for such postage values to be printed on each of the items 17 which are to be sequentially processed by the printing module 13, until the inquiry of step 324 is answered affirmatively. Whereupon the postage meter program 300 implements the step 326 of causing the microprocessor 18 to transmit an acknowledgment to the printing system 13 of the disconnect request 230 received by the postage meter at step 324. Thereafter, the printing system and postage meter programs 200 and 300, respectively return processing to steps 202 and 302, where the programs 200 and 300 again respectively continuously implements the step 202 and 302 of inquiring whether a request has been received to establish another semi-permanent, i.e., on-line, communication connection for processing the next mailrun.

Without departing from the spirit and scope of the invention the postage accounting computer module 12, and thus the postage meter 11, may be programmed for requesting a semi-permanent communication connection be implemented by the local computer 15, to permit the postage meter 11 to gain access to the mailing address database "M" stored in the local computer 15 and utilize the same for generating and printing on respective letters 17 both plain text mailing addresses and encrypted portions thereof. In this connection it is noted that the specific steps implemented by such programmed means are similar to those discussed above and are more specifically set forth in the appended claims.

What is claimed is:

1. A postage metering system comprising:

(a) a postage meter including first computer means for controlling the postage meter, the postage meter including first printing means for printing first postage information;

(b) non-secure second printing means external to the postage meter for printing second postage information, second computer means external to the postage meter and connected for controlling the second printing means, the second computer means including first means for transmitting to the first computer means variable information including at least a portion of a mailing address associated with an item to be imprinted with the second postage information;

(c) the first computer means including means for encrypting at least a portion of the transmitted variable information, the first computer means including second means for transmitting to the second computer means the encrypted information for printing by the second printing means on said item.

2. The postage metering system of claim 1, wherein the first postage information includes encrypted information.

3. The postage metering system of claim 2, wherein the encrypted first postage information does not include encrypted addressee information.

4. The postage metering system according to claim 1, wherein the second computer means includes means programmed for causing the second printing means to print on each letter the variable information therefor, whereby the relationship between the variable information and corresponding encrypted information is verifiable.

5. The postage metering system according to claim 1, wherein the second computer means includes means programmed for transmitting a request to the postage meter for permission to print the encrypted information.

6. The postage metering system according to claim 5, wherein the variable information includes a value of postage for printing on the item, the first computer means including means programmed for transmitting a permission-to-print message to the second computer means, and the first computer means including means programmed for debiting a credit value by an amount corresponding to the value of postage prior to transmitting the permission-to-print message.

7. The postage metering system according to claim 1, wherein the second computer means includes means programmed for transmitting a request to the postage meter for fixed information.

8. The postage metering system according to claim 1, wherein the second computer means includes means programmed for transmitting a request to the postage meter for establishing a semi-permanent communication connection therewith, and the first computer means including means for semi-permanently connecting the first and second computer means in response to the request therefor.

9. The postage metering system according to claim 1, wherein the second computer means includes means programmed for transmitting mailrun information to the postage meter, and the mailrun information including at least a number corresponding to a predetermined plurality of items.

10. The postage metering system according to claim 8, wherein the second computer means includes means programmed for transmitting to the postage meter a request to disconnect the semi-permanent communication connection, and the first computer means including means programmed for disconnecting the semi-permanent connection in response to the request therefor.

11. The postage metering system according to claim 1, wherein the encrypted information is a bit mapped image, the variable information includes a postage value, and the first computer means programmed for debiting a credit value by an amount corresponding to the postage value prior to transmitting the bit-mapped image of the encrypted information.

12. A postage metering system comprising:

(a) a postage meter including means for printing, the postage meter including first computer means for controlling the printing means, the printing means including printing apparatus and means for sequentially feeding each letter of a plurality thereof to the printing apparatus;

(b) second computer means externally of the postage meter, the second computer means including means programmed for sequentially transmitting variable information for each letter to the postage meter, the variable information including at least a portion of a mailing address for each letter;

(c) the first computer means including means for connecting the postage meter in communication with the second computer means, the first computer means including means for sequentially encrypting the variable information received for each letter, the first computer means including means programmed for causing the printing means to print on each letter a bit-mapped image of fixed information, and the first computer means including means programmed for causing the printing apparatus to sequentially print on each letter a bit-mapped image of the encrypted information for each letter.

13. The postage metering system according to claim 12, wherein the first computer means includes means programmed for causing the printing apparatus to print on each letter the variable information pertaining thereto, whereby the relationship between the variable information and corresponding encrypted information is verifiable.

14. The postage metering system according to claim 12, wherein the first computer means includes means programmed for merging a value of postage with the variable information, and the first computer means including means programmed for debiting a credit value by an amount corresponding to the value of postage.

15. The postage metering system according to claim 12, wherein the first computer means includes means programmed for transmitting a request to the second computer means for establishing a semi-permanent communication connection therewith, and the connecting means semi-permanently connecting the second computer means with the first computer means in response to the request therefor.

16. The postage metering system according to claim 15, wherein the first computer means includes means programmed for transmitting to the second computer means a request to disconnect the semi-permanent communication connection therewith, and the second computer means including means programmed for disconnecting the semi-permanent connection in response to the request therefor.

17. The postage metering system according to claim 12, wherein the variable information includes a value of postage, and the first computer means programmed for debiting a credit value by an amount corresponding to the value of postage prior to printing the bit-mapped image of the encrypted information.

18. A postage metering system comprising:

a) a postage meter including first computer means for controlling the postage meter, the postage meter including first printing means for printing first postage information;

(b) second printing means external to the postage meter for printing second postage information, second computer means external to the postage meter and connected for controlling the second printing means, the second computer means including first means for transmitting to the first computer means variable information including at least a portion of a mailing address associated with an item to be imprinted with the second postage information;

(c) the first computer means adapted to receive the transmitted variable information;

(d) the first computer means including means for encrypting at least a portion of the transmitted variable information, the first computer means including second means for transmitting to the second computer means the encrypted information for printing by the second printing means on the item.

19. The postage metering system of claim 18, wherein the first postage information includes encrypted information.

20. The postage metering system of claim 19, wherein the encrypted first postage information does not include encrypted addressee information.

* * * * *

UNITED STATES PATENT AND TRADEMARK OFFICE

CERTIFICATE OF CORRECTION

PATENT NO. : 5,682,427

DATED : October 28, 1997

INVENTOR(S) : Frank E. Seestrom

It is certified that error appears in the above-identified patent and that said Letters Patent is hereby corrected as shown below:

The Title page, showing an illustrative figure should be deleted and substitute therefor the attached Title page.

Figure 3:
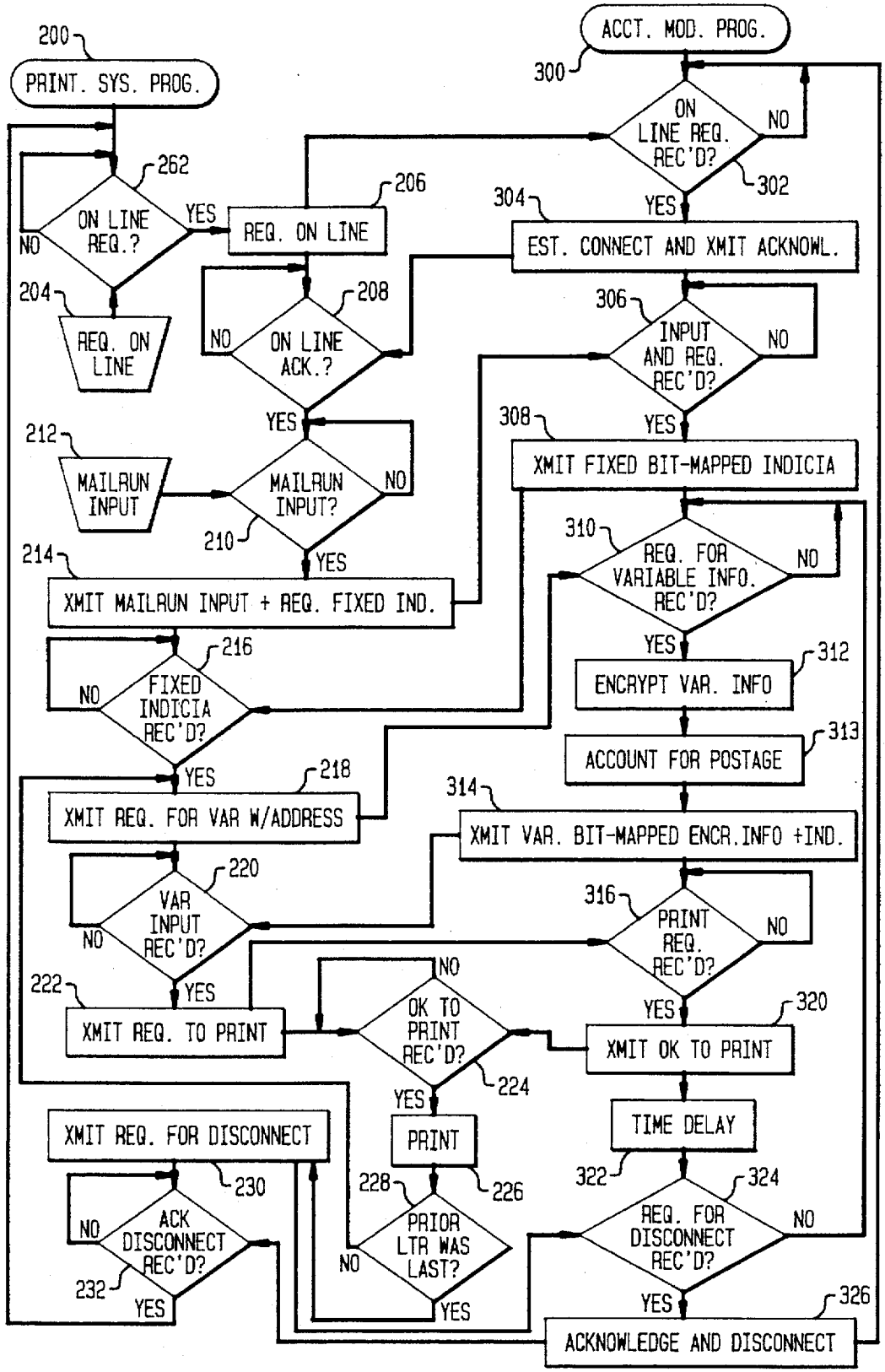
FIG. 3 is a flow chart of the processes implemented by the postage meter and printing system for causing the printing system to print the verifiable encrypted information.
Figure 3:
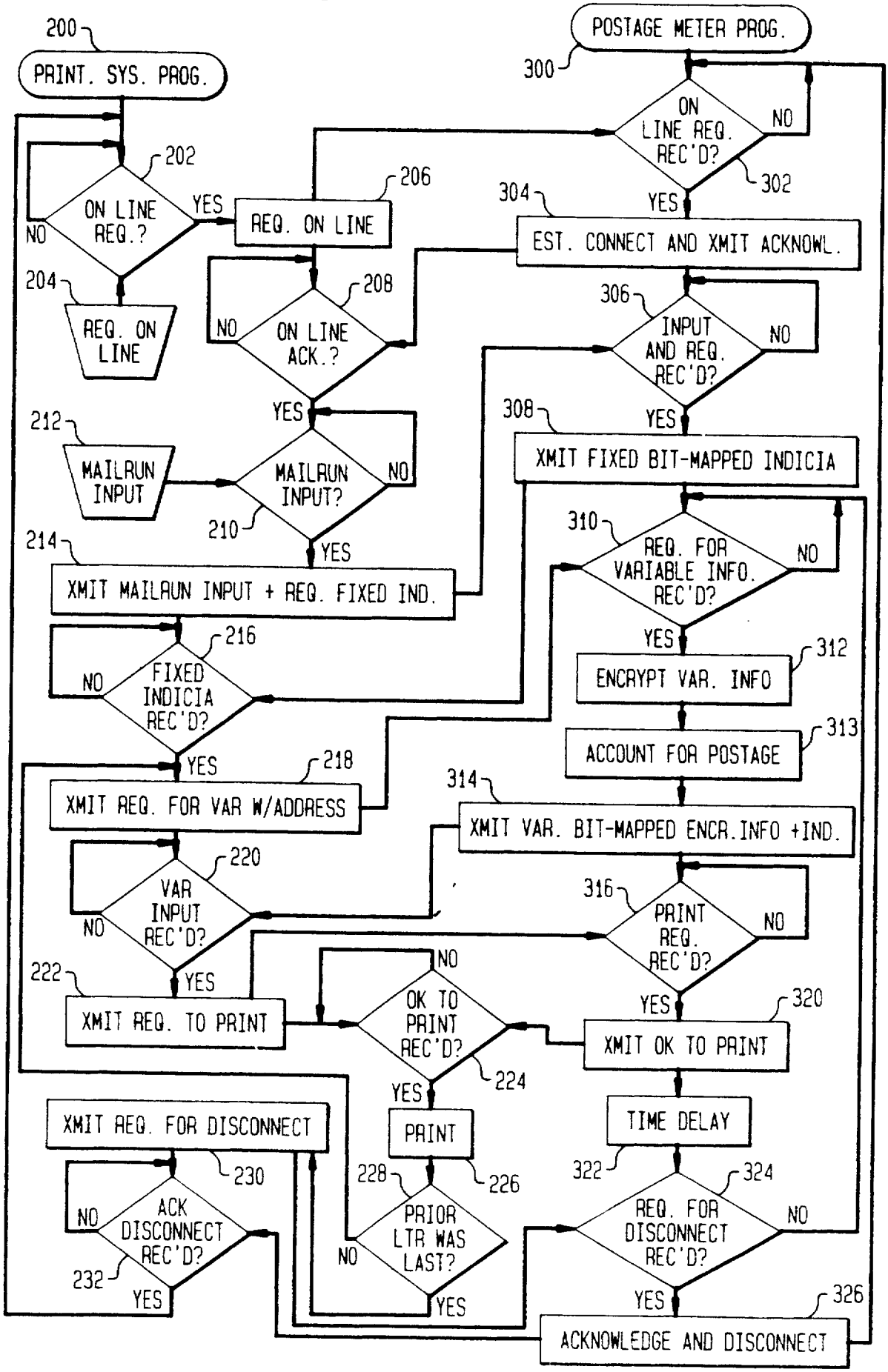

Drawings:

Delete Figures 1 and 3 and substitute therefor Figures 1 and 3 as shown on the attached pages.

Signed and Sealed this

First Day of September, 1998

*Attest:*

*Attesting Officer*

BRUCE LEHMAN

*Commissioner of Patents and Trademarks*

United States Patent [19]

Seestrom

[11] Patent Number: 5,682,427

[45] Date of Patent: Oct. 28, 1997

[54] POSTAGE METERING SYSTEM WITH DEDICATED AND NON-DEDICATED POSTAGE PRINTING MEANS

[75] Inventor: Frank E. Seestrom, Weston, Conn.

[73] Assignee: Pitney Bowes Inc., Stamford, Conn.

[21] Appl. No.: 356,748

[22] Filed: Dec. 15, 1994

[51] Int. Cl.[6] ..... G07B 17/00

[52] U.S. Cl. ..... 380/51; 380/55; 364/464.18

[58] Field of Search ..... 380/51, 54, 55; 364/464.02

[56] References Cited

U.S. PATENT DOCUMENTS

| | | | |
|---|---|---|---|
| 4,743,747 | 5/1988 | Fougere et al. | 380/51 X |
| 4,864,618 | 9/1989 | Wright et al. | 380/51 |
| 4,949,381 | 8/1990 | Pastor | 380/51 |

*Primary Examiner*—Gilberto Barron, Jr.

*Attorney, Agent, or Firm*—Charles R. Malandra, Jr.; David E. Pitchenik; Melvin J. Scolnick

[57] ABSTRACT

A postage metering system comprising: a postage meter including a first computer for controlling the postage meter, the postage meter including a first printer for printing first postage information; a non-secure second printer external to the postage meter for printing second postage information, a second computer external to the postage meter and connected for controlling the second printer, the second computer including first structure for transmitting to the first computer variable information including at least a portion of a mailing address associated with an item to be imprinted with the second postage information; the first computer including structure for encrypting at least a portion of the transmitted variable information, the first computer including second structure for transmitting to the second computer the encrypted information for printing by the second printer on said item.

20 Claims, 3 Drawing Sheets

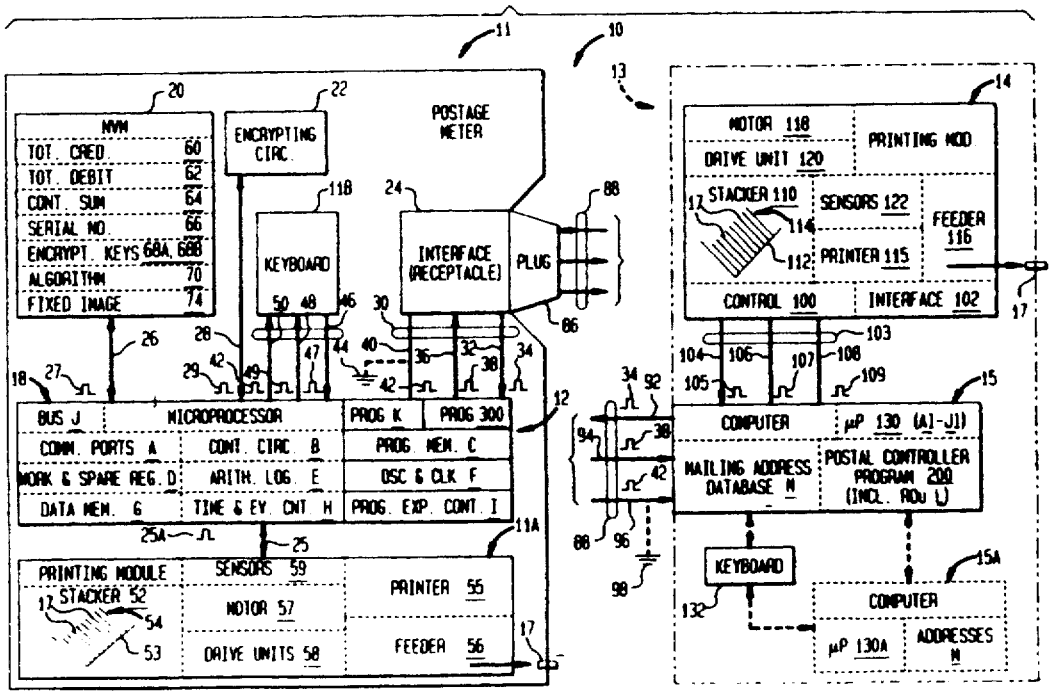

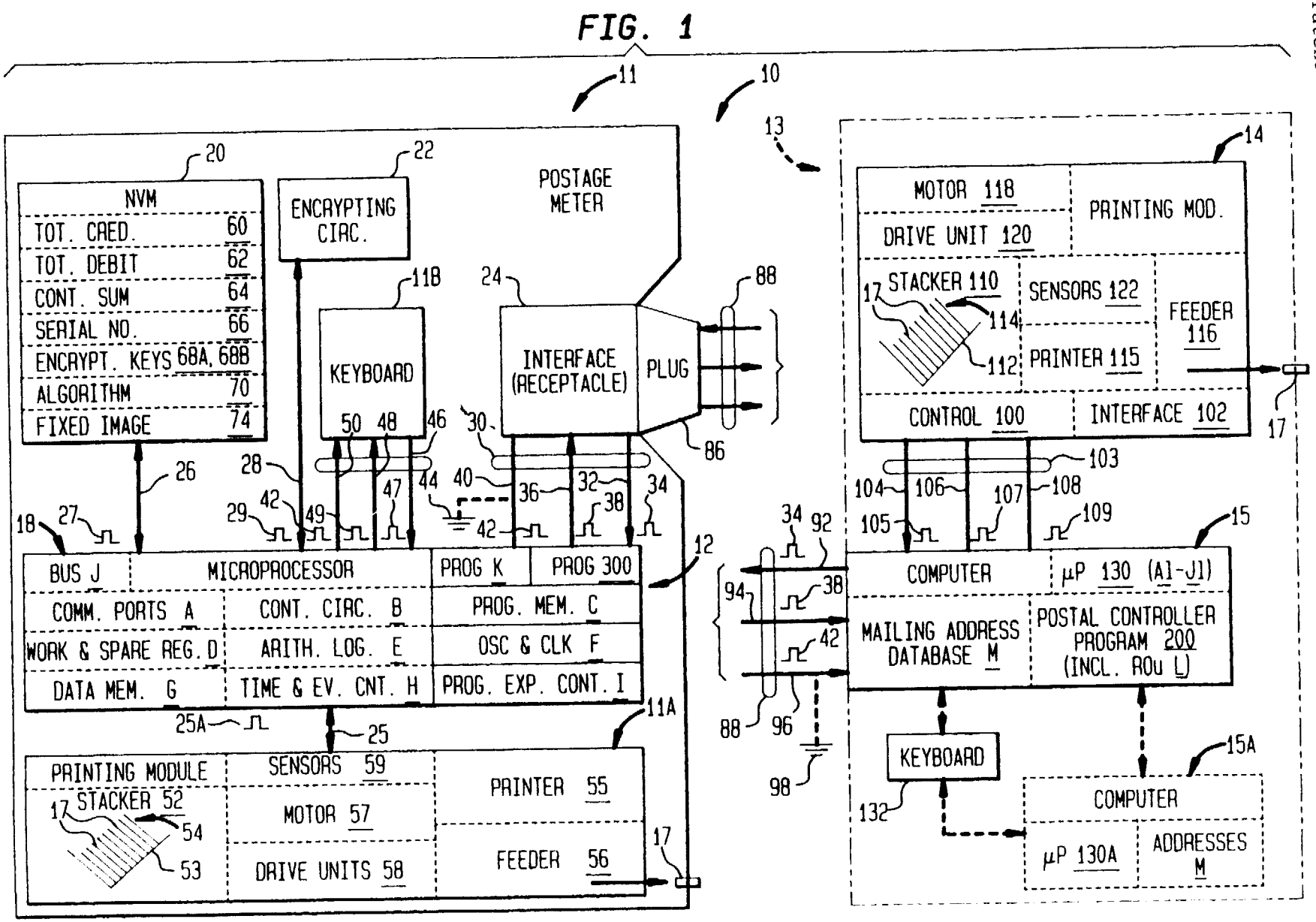
FIG. 1
PRINTING MOD.
MOTOR 118
DRIVE UNIT 120
STACKER 110
FEEDER 116
SENSORS 122
PRINTER 115
INTERFACE 102
CONTROL 100
COMPUTER
μP 130 (A1-J1)
POSTAL CONTROLLER PROGRAM 200 (INCL. ROu L)
MAILING ADDRESS DATABASE M
KEYBOARD
COMPUTER
ADDRESSES M
μP 130A
POSTAGE METER
PLUG
INTERFACE (RECEPTACLE)
ENCRYPTING CIRC.
KEYBOARD
NVM
TOT. CRED.
TOT. DEBIT
CONT. SUM
SERIAL NO.
ENCRYPT. KEYS 68A, 68B
ALGORITHM
FIXED IMAGE
MICROPROCESSOR
BUS J
COMM. PORTS A
WORK & SPARE REG. D
DATA MEM. G
CONT. CIRC. B
ARITH. LOG. E
TIME & EV. CNT. H
PROG. MEM. C
OSC & CLK F
PROG. EXP. CONT. I
PROG K
PROG 300
PRINTER 55
FEEDER 56
SENSORS 59
MOTOR 57
DRIVE UNITS 58
PRINTING MODULE
STACKER 52